US005470143A

United States Patent [19]

Gill

[11] Patent Number: 5,470,143

[45] Date of Patent: Nov. 28, 1995

[54] SELF-LOCKING SNAP-ON SUSPENSION UNIT FOR FURNITURE CABINETS AND THE LIKE

[75] Inventor: John F. Gill, Grand Rapids, Mich.

[73] Assignee: Steelcase Inc., Grand Rapids, Mich.

[21] Appl. No.: 217,256

[22] Filed: Mar. 24, 1994

[51] Int. Cl.[6] ..... A47B 88/16

[52] U.S. Cl. ..... 312/334.4; 312/334.11; 312/334.38; 312/334.17; 312/334.25; 312/334.26; 312/334.33; 384/18; 292/18; 292/228

[58] Field of Search ..... 312/334.4, 334.8, 312/334.32, 334.11, 334.38, 334.47, 334.17, 334.25, 334.26, 334.33, 348; 108/107, 110; 211/207, 191, 192; 403/321, 353, 384; 384/19, 18

[56] References Cited

U.S. PATENT DOCUMENTS

| | | | |
|---|---|---|---|
| 1,508,259 | 9/1924 | Stafford . | |
| 3,119,643 | 1/1964 | Levi et al. | 312/334.4 |
| 3,377,115 | 4/1968 | Hansen et al. | 312/334.17 |
| 3,572,874 | 3/1971 | Hassel | 312/350 |
| 3,677,615 | 7/1972 | Hudson | 312/346 |
| 3,712,698 | 1/1973 | Propst et al. | 312/350 |
| 3,716,284 | 2/1973 | Vogt | 312/334.4 |
| 3,771,849 | 11/1973 | Barber | 312/350 |
| 3,923,347 | 12/1975 | Dean | 312/348 |
| 4,147,393 | 4/1979 | Nelson et al. | 308/3.6 |
| 4,157,228 | 6/1979 | Hammerschlag | 211/192 |
| 4,183,596 | 1/1980 | Greene et al. | 312/334 X |
| 4,469,384 | 9/1984 | Fler et al. | 312/334 X |
| 4,566,743 | 1/1986 | Henriott | 312/350 |
| 4,575,164 | 3/1986 | Pinnow et al. | 312/350 |
| 4,681,289 | 7/1987 | Gronlund et al. | 248/224.4 |
| 4,681,381 | 7/1987 | Sevey | 312/333 |
| 4,792,195 | 12/1988 | Adriaansen et al. | 312/245 |
| 4,834,555 | 5/1989 | Grass | 384/19 |
| 4,872,734 | 10/1989 | Rechberg | 384/19 |
| 4,913,580 | 4/1990 | Whitehead | 403/353 |
| 4,928,834 | 5/1990 | Neiman | 211/191 |
| 4,998,828 | 3/1991 | Hobbs | 384/18 |
| 5,211,461 | 5/1993 | Teutel et al. | 312/334.4 |

*Primary Examiner*—Jose V. Chen
*Assistant Examiner*—Rodney B. White
*Attorney, Agent, or Firm*—Price, Heneveld, Cooper, DeWitt & Litton

[57] ABSTRACT

A suspension unit for roll-out shelves, drawers, etc. is provided for furniture cabinets and the like of the type having a case with slotted interior uprights. The suspension unit includes an inner housing member connected with a drawer or other roll-out furniture member, and an outer housing member operably connected with the inner housing member for smooth longitudinal sliding translation between the same. The outer housing member has prongs which engage the slotted upright when shifted longitudinally in a first direction. A resiliently flexible lock arm is connected with the outer housing member, and is configured to assume a normally outwardly protruding position. The lock arm is laterally flexible into an inwardly retracted position, and is oriented generally opposite the direction of the prongs, such that when the prongs are inserted into the slotted uprights, the lock arm abuts and adjacent upright to shift the lock arm into the retracted position. When the outer housing member is shifted longitudinally into its engaged position in the case, the lock arm resiliently flexes back into its normally extended position against the side of the adjacent upright to positively prevent inadvertent removal of the suspension unit from the case.

20 Claims, 3 Drawing Sheets

SELF-LOCKING SNAP-ON SUSPENSION UNIT FOR FURNITURE CABINETS AND THE LIKE

BACKGROUND OF THE INVENTION

The present invention relates to suspension devices for furniture cases, cabinets and the like, and in particular to a self-locking, snap-on construction therefor.

Suspension devices are generally well known in the art, and are designed to slidably support roll-out furniture members, such as drawers, retractable shelves, etc. in cases, cabinets, and other similar furniture articles. Such suspension units typically include an outer housing member which is attached to the interior of the case, and an inner housing member which is attached to the drawer or other roll-out furniture member. A bearing arrangement, such as glides, ball bearing carriers, etc. slidably interconnect the inner and outer housing members to permit smooth longitudinal telescoping motion therebetween. Progressive suspension units also include an intermediate channel member slidably mounted between the outer and inner housing members.

Modern office furniture cases for file drawers, storage, and the like are typically equipped with removable suspension units, which are attached to slotted uprights on the interior of the case, so as to permit the location of the various drawers, roll-out shelves, etc. to be adjusted within the interior of the case to accommodate different users and tasks. Lock mechanisms may be provided on the removable suspension units to insure that they can not inadvertently detached from their selected position.

Heretofore, the locking devices associated with removable suspension units have typically had a rather expensive, complex construction, and are difficult to operate, particularly in the very limited space available within the interior of the associated cabinet.

SUMMARY OF THE INVENTION

One aspect of the present invention is to provide a self-locking, snap-on suspension unit for furniture cabinets of the type having a case with slotted interior uprights. The suspension unit includes an inner housing member shaped for connection with an associated drawer or the like, and an outer housing member operably interconnected with the inner housing member for smooth longitudinal sliding translation therebetween. The outer housing member has prongs, which are closely received in the slotted interior uprights, and are oriented in a first direction to engage the same when the outer housing member is shifted longitudinally in a first direction to an engaged position. A resiliently flexible locking arm is connected with the outer housing member, and is configured to assume a normally outwardly protruding position. The lock arm is laterally flexible into an inwardly retracted position, and is oriented generally opposite the direction of the prongs, such that when the prongs are inserted into the slotted uprights, the lock arm abuts adjacent one of the uprights to shift the same into the retracted position. When the outer housing member is shifted longitudinally into its fully engaged position in the case, the lock arm resiliently flexes back into its normally extended position against the side of the adjacent upright to positively prevent inadvertent removal of the suspension unit from the case.

Preferably, the lock arm and prongs are formed integrally with the outer housing member to provide a one-piece construction, and the lock arm is constructed to be manually flexible to facilitate removing the suspension unit from the case without tools.

The principal objects of the present invention are to provide a self-locking, snap-on suspension unit for cabinets and the like. A resiliently flexible lock arm is provided in an outer housing member of the suspension unit, and automatically shifts into a locked position when the suspension unit is snapped into place in the case. The lock arm is preferably formed integrally with the outer housing to reduce manufacturing costs, and has an uncomplicated construction, yet provides a very positive type of locking action which prevents inadvertent removal or disengagement: of the suspension unit from the case. The locking arm can be manually shifted to its unlocked position to permit easy removal of the suspension unit when desired, without requiring tools.

These and other advantages of the invention will be further understood and appreciated by those skilled in the art by reference to the following written specification, claims and appended drawings.

DETAILED DESCRIPTION OF THE PREFERRED EMBODIMENTS

Figure 1:
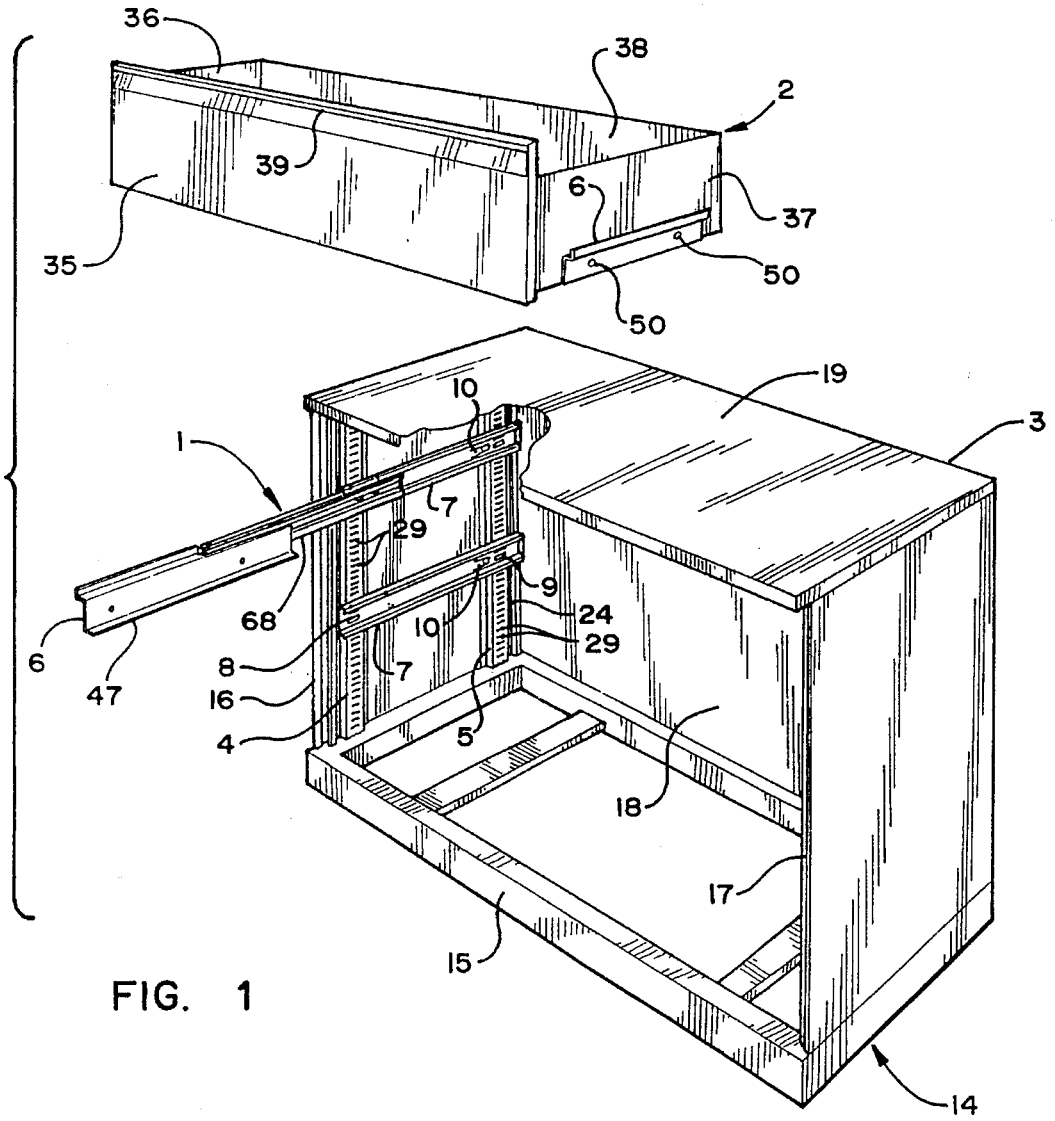
FIG. 1 is a perspective view of a self-locking snap-on suspension unit embodying the present invention, shown installed in an associated furniture case, wherein portions thereof have been exploded and broken away to reveal internal construction.
Figure 2:
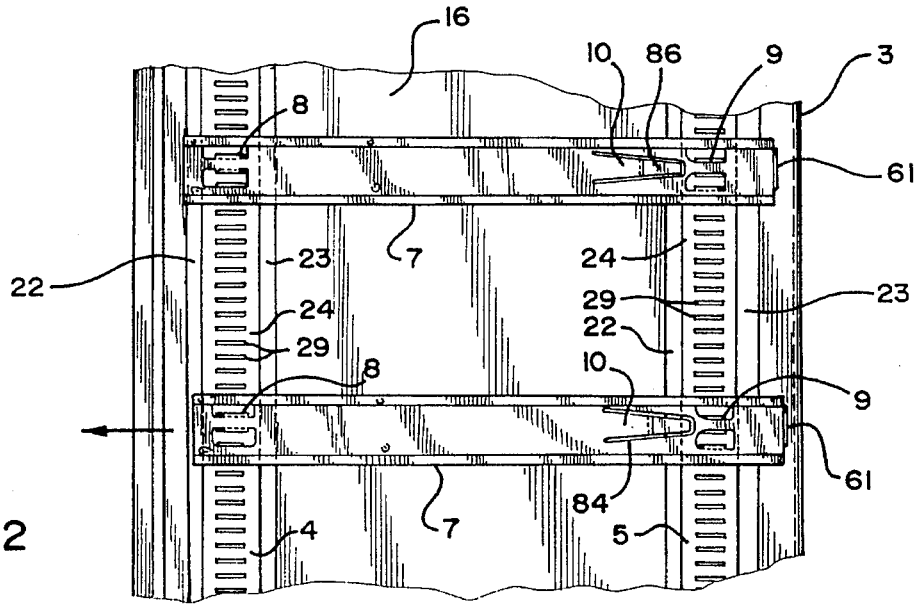
FIG. 2 is a side elevational view of outer housing portions of a pair of the suspension units, wherein the upper suspension housing is shown in a fully installed and locked position in the case, and the lower suspension housing is shown in a partially installed and unlocked position in the case.
Figure 3:
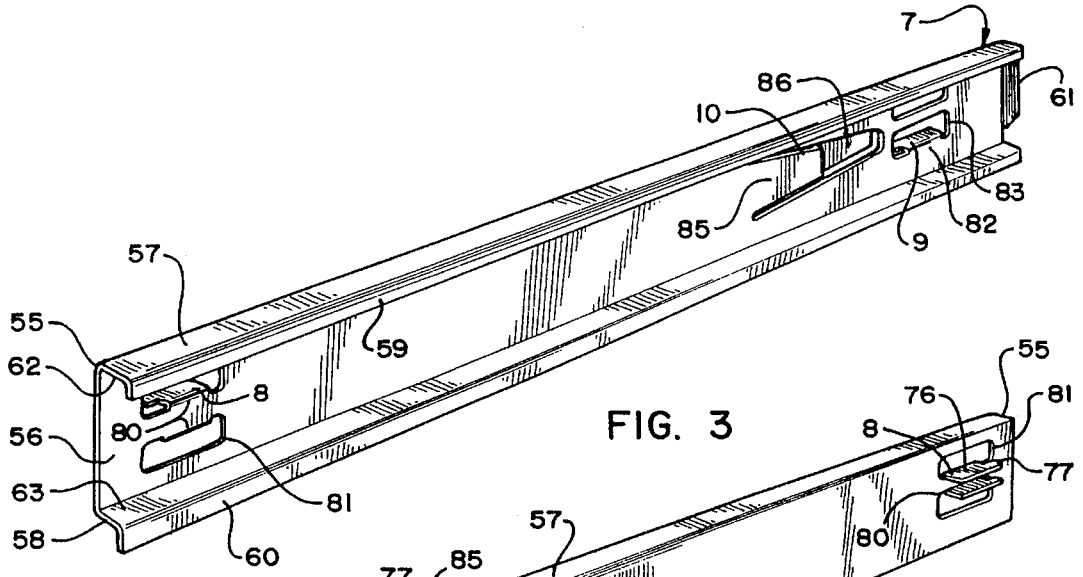
FIG. 3 is a front perspective view of the outer housing portion of the suspension unit.

For purposes of description herein, the terms "upper", "lower", "right", "left", "rear", "front", "vertical", "horizontal", and derivatives thereof shall relate to the invention as oriented in FIGS. 1 and 2. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 4:
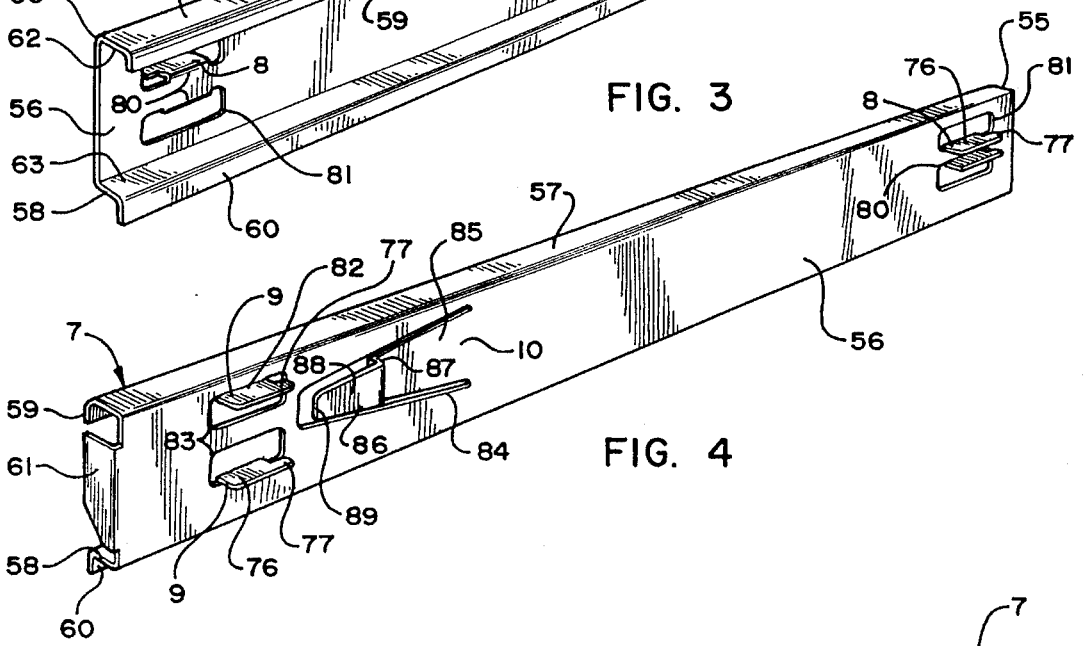
FIG. 4 is a rear perspective view of the outer housing.
Figure 5:
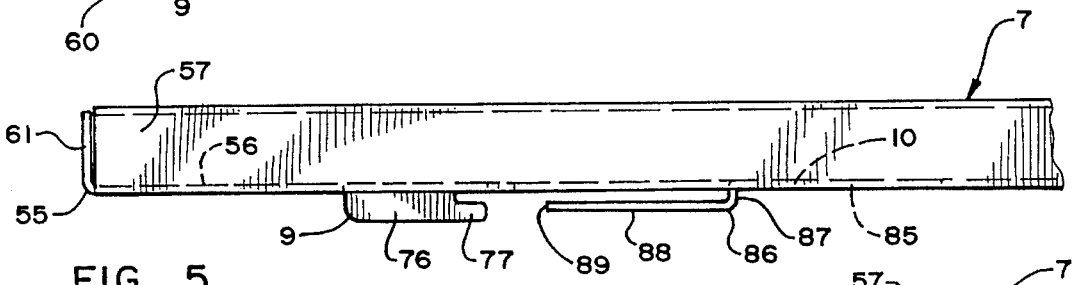
FIG. 5 is an enlarged, fragmentary top plan view of the outer housing.
Figure 6:
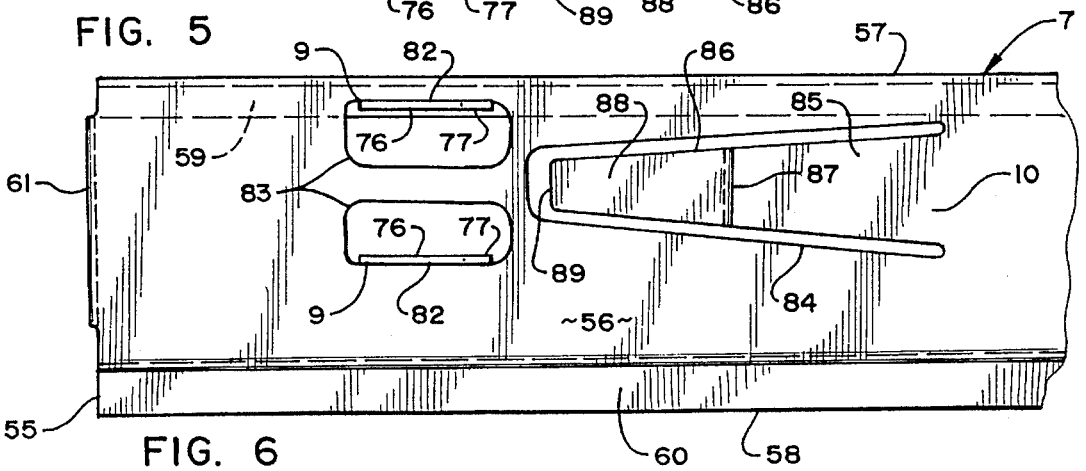
FIG. 6 is an enlarged, fragmentary rear elevational view of the outer housing.
Figure 7:
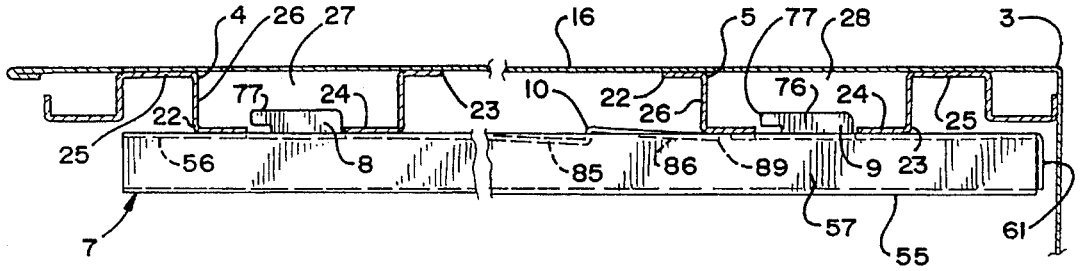
FIG. 7 is a top plan view of the outer housing, shown in the partially installed and unlocked position in the case.
Figure 8:
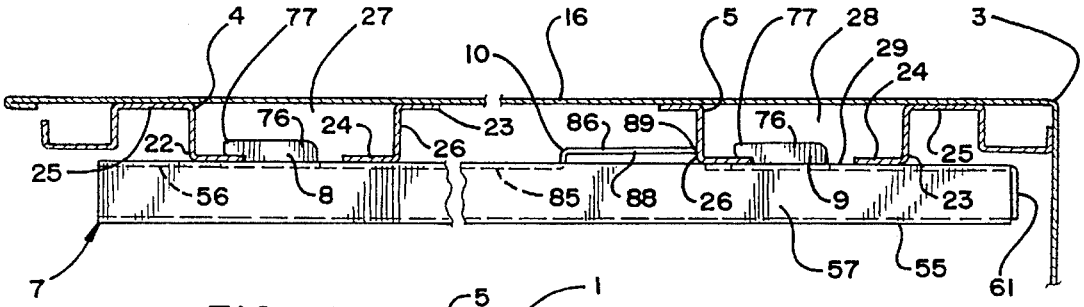
FIG. 8 is a top plan view of the outer housing, shown in the fully installed and locked position in the case.
Figure 10:
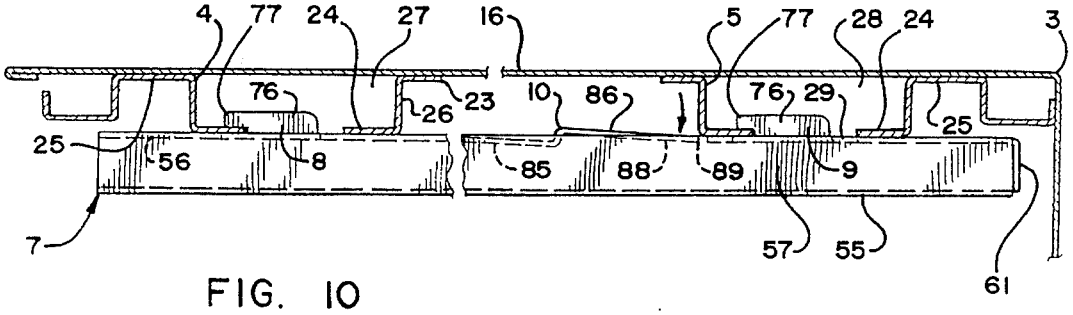
FIG. 10 is a top plan view of the: outer housing, shown in the fully installed position in the case, wherein the lock arm has been deflected to its unlocked position to permit removing the suspension unit from the case.

The reference numeral 1 (FIG. 1) generally designates a self-locking, snap-on suspension unit embodying the present invention. Suspension unit 1 is designed to mount a roll-out support, such as shelves, drawers, etc. in an associated furniture case, cabinet or the like. In the illustrated example, suspension unit 1 is for supporting a drawer 2 in a lateral file case 3. Lateral file case 3 is of the type having slotted interior uprights 4 and 5 located at the front and rear portions of case 3. Suspension unit 1 includes an inner housing member 6 connected with drawer 2, and an outer housing member 7 operably connected with inner housing member 6 by any one of a variety of different arrangements, as described below, for smooth longitudinal sliding translation therebetween. The outer housing member 7 has two set of prongs 8 and 9 (FIGS. 3–6) which engage the slotted uprights 4 and 5 (FIGS. 1 & 2) when shifted longitudinally in a first direction. A resiliently flexible lock arm 10 is connected with outer housing member 7, and is configured to assume a normally outwardly protruding position, as best shown in FIGS. 4 and 5. Lock arm 10 is laterally flexible into an inwardly retracted position, as shown in FIGS. 7 and 10, and is oriented generally opposite the direction of prongs 8 and 9, such that when prongs 8 and 9 are inserted into slotted uprights 4 and 5, lock arm 10 abuts an adjacent one of the uprights 5 to shift the same into the retracted position, as shown in FIG. 7. When the outer housing member 7 is shifted longitudinally into its fully engaged position in case 3, such as in the direction of the arrow in FIG. 2, lock arm 10 resiliently flexes back into its normally extended position against the side of the adjacent upright 5, as shown in FIG. 8, to positively prevent inadvertent removal of suspension unit 1 from case 3.

The illustrated case 3 (FIGS. 1 & 2) is for a two drawer lateral file cabinet 14, which includes a base 15, and interconnected sidewalls 16 and 17, back wall 18, and top 19. Each of the sidewalls 16 and 17 has two uprights 4 and 5 extending along the interior surface thereof adjacent forward and rearward portions of case 3. Uprights 4 and 5 serve to stiffen the sidewalls 16 and 17 of case 3, and facilitate mounting suspension units 1, and associated drawers 2 in the interior of case 3. The rear uprights 5 also act as stops on the interior of case 3, which interface with the lock arms 10 on suspension units 1 in the manner described below. As best illustrated in FIGS. 7 and 8, uprights 4 and 5 have a substantially identical construction, wherein each includes portions with a generally U-shaped horizontal cross-sectional configuration, comprising opposite side flanges 22 and 23, and a central interconnecting web 24. Side flanges 23 and 24 each has a generally L-shaped plan configuration, including a generally flat attachment arm 25 which is rigidly connected to the interior surface of the associated case sidewall 16, and a standoff arm 26 oriented perpendicular thereto. Uprights 4 and 5, in conjunction with associated case sidewall 16, form hollow channels 27 and 28 in which suspension unit prongs 8 and 9 respectively, are received, as described in greater detail hereinafter. As best illustrated in FIGS. 1 and 2, the web 24 of each of the uprights 4 and 5 includes a plurality of horizontally oriented slots 29 therethrough, which are arranged in a vertically extending column, and are spaced generally equidistantly along the length of each of the uprights 4 and 5. In an illustrated example, slots 29 are provided at one-half inch intervals along associated uprights 4 and 5, so that a drawer suspension unit 1 and associated drawer 2 can be positioned at any similar increment therealong.

The illustrated drawer 2 (FIG. 1) has a substantially conventional construction, comprising a front 35, opposite sidewalls 36 and 37, a rear wall 38, and a bottom (not shown), all of which are integrally interconnected to form a rigid, generally rectangular file drawer. A pull 39 is integrally formed in drawer front 35 to facilitate opening the same. In the arrangement illustrated in FIG. 1, an inner housing member 6 is shown preattached to sidewall 37 of drawer 2.

The illustrated inner housing member 6 (FIG. 9) has a conventional construction, and is in the form of a generally Z-shaped channel having a vertically oriented web 46, and a pair of horizontally oriented flanges 47. The outer end of upper flange 47 is formed upwardly to define a bearing race in which ball bearings 49 are retained. The web 46 of inner housing member 6 includes horizontally oriented apertures through which fasteners 50 are closely received to detachably mount drawer 2 on inner housing member 6.

The illustrated outer housing member 7 (FIGS. 3–6) comprises a generally C-shaped channel 55 having a vertically oriented web 56, and two horizontally oriented flanges 57 and 58 extending therefrom. The upper flange 57 has a downwardly protruding lip 59 extending along the free edge thereof, and the lower flange 58 similarly has a depending lip 60 extending along its free edge. An end tab 61 is positioned at the rearward end of channel 55, and extends inwardly therefrom in between flanges 57 and 58. The channel flanges 57 and 58 define opposite bearing races 62 in which ball bearings 64 (FIG. 9) are received to slidably interconnect inner housing member 6 with outer housing member 7, as described in greater detail below.

In the illustrated example, suspension unit 1 includes an intermediate channel member 68 (FIG. 9), which slidably interconnects inner housing member 6 and outer housing member 7 for smooth longitudinal translation therebetween. Intermediate channel member 68 has a generally C-shaped configuration, comprising a vertically oriented web 69, and a pair of outwardly protruding flanges 70. Channel flanges 70 form bearing races adjacent opposite ends thereof, which mate with ball bearings 64 to slidably interconnect inner housing member 6 with outer housing member 7. As will be appreciated by those skilled in the art, the present invention contemplates that other types of bearing arrangements can also be used to slidably interconnect inner housing member 6 with outer housing member 7.

Figure 9:
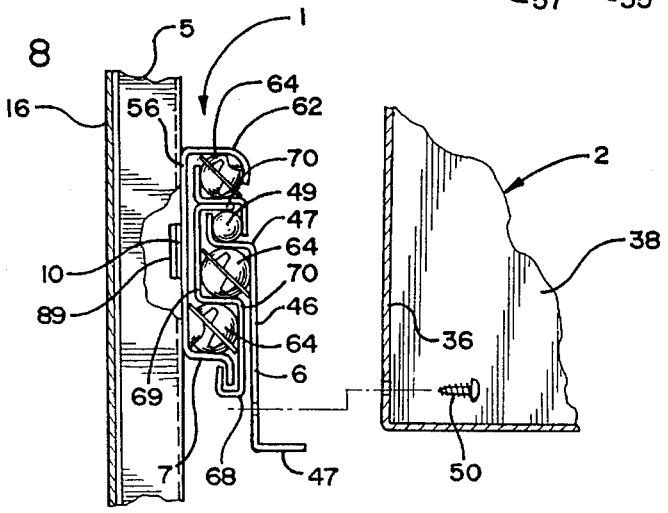
FIG. 9 is a vertical cross-section view of the suspension unit, shown mounted in the case adjacent an associated drawer.

The prongs 8 and 9 incorporated into the illustrated outer housing member 7 (FIGS. 3–6) are formed integrally with the web, 56 of outer housing channel 55 adjacent opposite ends thereof, so as to provide a one-piece housing construction. The forward and rearward sets of prongs 8 and 9 each include a pair of prongs having a generally similar hook-shaped side elevational configuration which protrudes outwardly toward case 3 from the outer housing channel 55. More specifically, each of the prongs 8 and 9 has a flat tab portion 76 which projects horizontally outwardly from the outer surface of channel web 56, and a forwardly extending tip portion 77. The forward prongs 8 are punched from the web 56 of outer housing channel 55, and bent outwardly along the interior edges 80 of associated windows 81, so that prongs 8 are positioned mutually parallel, and fairly close together. In contrast, the rear prongs 9 are punched from the web 56 of outer housing channel 55, and bent outwardly about the outer edge 82 of associated windows 83, so that prongs 9 are positioned mutually parallel, yet are spaced further apart than the forward prongs 8. For example, in the illustrated suspension unit 1, front prongs 8 are spaced apart a distance equal to the distance between two adjacent upright slots 29, whereas rear prongs 9 are spaced apart a distance equal to the distance between three adjacent upright slots 29. Both sets of prongs 8 and 9 are shaped to be closely received in the associated slots 29 in uprights 4 and 5, with the tip portions 77 oriented toward the front or open end of case 3, as illustrated in FIGS. 8 and 9. The tip portions 77 of prongs 8 and 9 are shaped to abuttingly glide over the interior surfaces of upright webs 24 when the outer housing member 7 is shifted forwardly into the fully installed and locked position illustrated in FIG. 8.

The illustrated lock arm 10 has a generally trapezoidal front elevational configuration, and is also integrally formed with the web 56 of outer housing channel 55, so as to provide a one-piece housing construction. As best illustrated in FIGS. 3–6, lock arm 10 is punched from the web 56 of channel 55 forming window 84, and includes a flat base portion 85 positioned generally planar with channel web 56, and an outwardly protruding or laterally offset tip portion 86, which has a generally L-shaped plan configuration, as best shown in FIG. 5. The tip portion 86 of lock arm 10 includes an outwardly protruding arm 87 and a flat end 88 disposed generally parallel with channel web 56. The end 88 of tip portion 86 has an outermost end edge 89, which interfaces with one of the rear uprights 5 in case 3 in the manner described below to provide a self-locking construction for suspension unit 1, which prevents inadvertent removal of suspension unit 1 from case 3. The tip portion 86 of lock arm 10 is oriented generally opposite prongs 8 and 9. In the example shown in FIGS. 7 and 8, the tip portion 86 of lock arm 10 points toward the closed rear or back of case 3, while the prongs 8 and 9 point toward the open front or face of case 3. Lock arm 10 is resiliently flexible in a lateral direction, preferably by hand, to shift between the retracted unlocked position shown in FIG. 7, and the extended locked position shown in FIG. 8. In one working embodiment of suspension unit 1, outer housing member 7 is formed from a single piece of sheet metal.

In use, suspension unit 1 is installed in case 3 in the following manner. Suspension unit 1 is first positioned at the elevation at which drawer 2 is desired to be mounted within case 3. The prongs 8 and 9 on outer housing member 7 are then inserted into associated aligned slots 29 in vertical uprights 4 and 5, and pushed laterally inwardly. As the rear prongs 9 are fully inserted into the associated slots 29 in rear upright 5, lock arm 10 is laterally flexed into its inwardly retracted position by contact with upright web 24, as illustrated in FIG. 7, thereby permitting the suspension unit 1 to be shifted forwardly in a horizontal direction, with the tip portions 77 of prongs 8 and 9 engaging the interior surfaces of the adjacent upright webs 24. When the outer housing member 7 is shifted longitudinally into its forwardmost, fully engaged position in case 3, as shown in FIG. 8, lock arm 10 resiliently flexes back into its normally extended locked position against the forward side flange 26 of rear upright 5, as shown in FIG. 8, to positively prevent inadvertent removal of suspension unit 1 from case 3. Essentially, the extended lock arm 10, and oppositely oriented prongs 8 and 9 positively capture outer housing member 7 on the vertical uprights 4 and 5 of case 3.

The inner housing member 6 associated with the installed outer housing member 7 is then pulled forwardly, so as to access the mounting apertures through which fasteners 50 are inserted. Fasteners 50 are then mounted in the sides of drawer 2, thereby detachably, yet securely mounting drawer 2 on inner housing member 6.

To remove drawer suspension unit 1 from case 3, such as for reconfiguration, repair, replacement, or the like, drawer 2 is first removed from the inner housing member 6 of suspension unit 1 by removing fasteners 50. Once the drawer 2 has been removed, the user can reach back into the interior of case 3, and manually flex the outer end 88 of lock arm 10 inwardly away from the sidewall 16 of case 3, in the manner shown by the arrow in FIG. 10. When the end edge 89 of lock arm 10 is flexed to a position either flush with or slightly outwardly of the web 56 of outer housing channel 55, the outer housing member 7 can be shifted longitudinally rearwardly to disengage prongs 8 and 9 from vertical uprights 4 and 5, and thereby permit removal of suspension unit 1 from case 3.

The self-locking snap-on system provided by suspension unit 1 permits easy and quick assembly of a wide variety of different types of pull-out drawers, shelves, etc. in furniture cases, cabinets and the like. The resilient lock arm 10 automatically shifts into its locked position when suspension unit 1 is fully installed within case 3, and provides a very positive type of locking action that prevents inadvertent removal and/or disengagement of the suspension unit 1 from case 3. The integral construction of lock arm 10 and prongs 8 and 9 with outer housing member 7 permits economical manufacture, as well as an uncomplicated design. Since lock arm 10 can be manually shifted to its unlocked position, suspension unit 1 can be easily removed from case 3 without requiring any tools.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. A furniture cabinet, comprising:

a case having an interior portion with a plurality of horizontally oriented mounting slots positioned adjacent front and rear portions thereof;

a stop located on the interior portion of said case;

a roll-out support shaped to be slidably supported in the interior portion of said case for movement between extended and retracted positions;

at least one suspension unit slidably supporting said roll-out support in said case, and including:

an inner housing member connected with said roll-out support;

an outer housing member operably connected with said inner housing member for smooth longitudinal translation therebetween, and having at least two prongs spaced longitudinally apart to be closely received in said mounting slots adjacent the front and rear portions of said case, and being oriented in a first longitudinal direction to engage the interior portion of said case when said outer housing member is shifted longitudinally in the first direction to an engaged position;

a resiliently flexible lock arm connected with said outer housing member, and configured to assume a normally outwardly protruding position; said lock arm being laterally flexible into an inwardly retracted position, and oriented in a second longitudinal direction generally opposite said first longitudinal direction, such that when the prongs on said outer housing member are inserted into said mounting slots, said lock arm abuts said stop to resiliently shift the same into the retracted position, and when said outer housing member is shifted longitudinally into its engaged position in said case, said lock arm resiliently flexes back into its normally extended position against said stop to positively prevent inadvertent removal of said suspension unit from said case.

2. A furniture cabinet as set forth in claim 1, wherein:

said case interior portion includes at least one vertical upright having a generally U-shaped transverse cross-sectional configuration with opposite side flanges and an interconnecting web in which said mounting slots are disposed; and said upright defines said stop, such that when the prongs on said outer housing member are inserted into said mounting slots, said lock arm abuts the web of said upright to resiliently shift said lock arm into the retracted position, and when said outer housing member is shifted longitudinally into its engaged position in said case, said lock arm resiliently flexes back into its normally extended position against one of the side flanges of said upright to positively prevent inadverted removal of said suspension unit from said case.

3. A furniture cabinet as set forth in claim 2, wherein:

said lock arm is formed integrally with said outer housing member to provide a one-piece construction.

4. A furniture cabinet as set forth in claim 3, wherein:

said lock arm is constructed to be manually flexible into its inwardly retracted position to facilitate removing said suspension unit from said case without tools.

5. A furniture cabinet as set forth in claim 4, wherein:

said prongs are formed integrally with said outer housing member to provide a one-piece construction.

6. A furniture cabinet as set forth in claim 5, wherein:

said case includes at least two of said uprights positioned adjacent the front and rear portions of said case.

7. A furniture cabinet as set forth in claim 6, wherein:

said case has an open front portion, and a closed rear portion;

said first longitudinal direction m which said prongs are oriented is toward the open front portion of said case; and said second longitudinal direction in which said lock arm is oriented is toward the closed rear portion of said case.

8. A furniture cabinet as set forth in claim 7, wherein:

said roll-out support comprises a drawer.

9. A furniture cabinet as set forth in claim 8, wherein:

said prongs each have a hook shaped side elevational configuration which protrudes outwardly of said outer housing member.

10. A furniture cabinet as set forth in claim 1, wherein:

said lock arm is formed integrally with said outer housing member to provide a one-piece construction.

11. A furniture cabinet as set forth in claim 1, wherein:

said lock arm is constructed to be manually flexible to its inwardly retracted position to facilitate removing said suspension unit from said case without tools.

12. A furniture cabinet as set forth in claim 1, wherein:

said prongs are formed integrally with said outer housing member to provide a one-piece construction.

13. A furniture cabinet as set forth in claim 1, wherein:

said case has an open front portion, and a closed rear portion;

said first longitudinal direction in which said prongs are oriented is toward the open front portion of said case; and said second longitudinal direction in which said lock arm is oriented is toward the closed rear portion of said case.

14. A furniture cabinet as set forth in claim 1, wherein:

said roll-out support comprises a drawer.

15. A furniture cabinet as set forth in claim 1, wherein:

said prongs each have a hook shaped side elevational configuration which protrudes outwardly of said outer housing member.

16. A drawer suspension unit for furniture cabinets of the type having a case with horizontally slotted interior uprights adjacent front and rear portions thereof, comprising:

an inner housing member shaped for connection with an associated drawer;

an outer housing member operably connected with said inner housing member for smooth longitudinal translation therebetween, and having at least two prongs spaced longitudinally apart to be closely received in the slotted interior uprights adjacent the front and rear portions of the case, and oriented in a first longitudinal direction to engage the same when said outer housing member is shifted longitudinally in the first direction to an engaged position;

a resiliently flexible lock arm connected with said outer housing member, and configured to assume a normally outwardly protruding position; said lock arm being laterally flexible into an inwardly retracted position, and oriented in a second longitudinal direction, generally opposite said first longitudinal direction, such that when the prongs on said outer housing member are inserted into the slotted interior uprights, said lock arm abuts an adjacent one of the slotted interior uprights to resiliently shift said lock arm into the retracted position, and when said outer housing member is shifted longitudinally into its engaged position in the case, said lock arm resiliently flexes back into its normally extended position against the adjacent one of the slotted interior uprights to positively prevent inadvertent removal of said suspension unit from the case.

17. A furniture cabinet as set forth in claim 16, wherein:

said lock arm is formed integrally with said outer housing member to provide a one-piece construction.

18. A furniture cabinet as set forth in claim 17, wherein:

said lock arm is constructed to be manually flexible into its inwardly retracted position to facilitate removing said suspension unit from the case without tools.

19. A furniture cabinet as set forth in claim 18, wherein:

said prongs are formed integrally with said outer housing member to provide a one-piece construction.

20. A furniture cabinet as set forth in claim 19, wherein:

said prongs each have a hook shaped side elevational configuration which protrudes outwardly of said outer housing member.

* * * * *